US009383177B1

(12) United States Patent
Kallmes

(10) Patent No.: US 9,383,177 B1
(45) Date of Patent: Jul. 5, 2016

(54) HUNTING ARROW HAVING ONE RELEASE PASSAGE

(71) Applicant: Kim Eric Kallmes, Everett, WA (US)

(72) Inventor: Kim Eric Kallmes, Everett, WA (US)

( * ) Notice: Subject to any disclaimer, the term of this patent is extended or adjusted under 35 U.S.C. 154(b) by 0 days.

(21) Appl. No.: 14/545,206

(22) Filed: Apr. 6, 2015

Related U.S. Application Data

(60) Provisional application No. 61/975,868, filed on Apr. 6, 2014.

(51) Int. Cl.

| | |
|---|---|
| ***F42B 6/04*** | (2006.01) |
| ***F42B 12/02*** | (2006.01) |
| ***F42B 6/08*** | (2006.01) |
| ***F42B 6/06*** | (2006.01) |
| ***F42B 12/36*** | (2006.01) |

(52) U.S. Cl.
CPC . *F42B 12/02* (2013.01); *F42B 6/06* (2013.01); *F42B 6/08* (2013.01); *F42B 12/362* (2013.01)

(58) Field of Classification Search
CPC ..... F42B 6/04; F42B 6/06; F42B 6/08; F42B 12/362
See application file for complete search history.

(56) References Cited

U.S. PATENT DOCUMENTS

| | | | | |
|---|---|---|---|---|
| 2,467,838 | A | 4/1949 | Lust et al. | |
| 2,554,012 | A | 5/1951 | Cohen | |
| 3,393,912 | A * | 7/1968 | De Lonais | F42B 6/04 473/581 |
| 3,617,060 | A | 11/1971 | Iezzi | |
| 4,166,619 | A | 9/1979 | Bergmann et al. | |
| 4,212,463 | A | 7/1980 | Repinski et al. | |
| 4,252,325 | A | 2/1981 | Weems et al. | |
| 4,277,069 | A | 7/1981 | Rouse | |
| 6,238,310 | B1 | 5/2001 | Morrison | |
| 6,719,652 | B1 | 4/2004 | Rhodes, Jr. | |
| 8,784,242 | B2 | 7/2014 | Gendregske | |
| 2003/0166425 | A1 | 9/2003 | Sutherland | |
| 2007/0225093 | A1 | 9/2007 | Kidwell | |

* cited by examiner

*Primary Examiner* — John Ricci
(74) *Attorney, Agent, or Firm* — Todd N. Hathaway

(57) ABSTRACT

A hunting arrow having an interior passage that permits both air and blood to flow freely therethrough. A broadhead at the front of the arrow has an intake opening that permits the flow to enter a tubular shaft of the arrow, and a nock at the rear has a discharge opening that permits the air and blood to exit the shaft. The blades of the broadhead are radially spaced to permit air and blood to enter the intake opening. The nock includes internal vanes that react with the flow of air exiting the discharge opening to impart rotation to the arrow. The nock also includes vents that allow a portion of the air to escape so as to react with channels on the exterior of the nock to further stabilize the arrow during flight.

12 Claims, 18 Drawing Sheets

HUNTING ARROW HAVING ONE RELEASE PASSAGE

RELATED APPLICATIONS

This application claims the benefit of U.S. Provisional Patent Application Ser. No. 61/975,868 filed on Apr. 6, 2014.

BACKGROUND a. Field of the Invention

The present invention relates generally to arrows for hunting game animals, and, more particularly, to a hunting arrow having a tubular shaft that provides passage for release of blood to aid in tracking an animal and that also provides a passage for air for directional stabilization of the arrow during flight.

b. Related Art

Ancient in origin, bow hunting of game animals is increasingly popular in present times. Many or most states in the United States provide separate and/or extended seasons for bow hunting as compared with rifle hunting, sometimes both before and after the rifle season. Moreover, the challenges, relative safety and enjoyment inherent in bow hunting have drawn new participants to the sport who have not previously been involved in hunting.

The challenges of bow hunting naturally involve certain difficulties, some of which have raised significant concerns. For example, when shot with a high power rifle a game animals frequently will drop on the spot or travel only a short distance before collapsing owing to substantial trauma/blood loss. This is rarely the case with bow hunting, due to the lesser ability of broadhead arrows to impart shock/tissue damage; moreover limitations in accuracy render it difficult to hit vital areas that would quickly incapacitate the animal. Consequently, even mortally wounded game animals are frequently able to run for a significant amount of time after being struck and thus must be tracked over considerable distances by the hunter. Moreover, the limited size of the wound and the tendency of the skin to retract around the shaft of the arrow can combine to minimize external bleeding so as to make tracking exceedingly difficult, especially in brushy or rough terrain. A large portion of animals therefore die without being found, with studies in some states estimating losses at nearly 50%. This has raised concerns for not only for reason of wastage but also on ethical grounds.

As noted above, problems with accuracy constitute a significant factor in the loss of wounded game animals due to the difficulty in hitting vital areas that would affect a quicker kill, and they also detract from enjoyment of the sport on the whole. One of the problems stems from the traditional fletching on arrows, which typically takes the form of "fins" (usually three in number) made of feathers or other flexible material that are mounted on and extend generally radially from the "nock," the latter being a structure at the rearward end of the shaft of the arrow and that includes a notch that fits over the drawstring of the bow. The fletching serves to stabilize the arrow in flight. However, due to the design and function of most bows, the fletching will also typically hit the side of the bow during release (one of the reasons conventional fletching is formed of flexible material), creating a certain amount of deflection at the outset. The fletching also creates an enlarged effective diameter at the rear of the arrow, defined by the tips of the "fins," making it difficult for the arrow to pass by and through twigs and branches without the fletching striking and knocking the arrow off course. The fletching also creates drag that tends to slow the arrow en route to the target, affecting both accuracy and the arrow's ability to penetrate tissue in an effective manner.

Conventional fletching can also negatively impact aim and correct arrow placement in an indirect manner, due its visibility to the target animal. Deer in particular have acute eyesight and an exceptional ability to detect visible movement. Even if the hunter exercises care, the comparatively large, flat surfaces of the fletching tend to produce a visible "flicking" effect as the arrow is brought into position and hunter takes aim; if detected the animal may start, making it difficult to hit and possibly resulting in poor placement of the arrow such that it fails to result in a humane kill.

Certain efforts have previously been made at increasing the external discharge of blood from an arrow wound in order to aid in tracking the animal, including those disclosed in the following references: U.S. Pat. No. 8,7884,242, U.S. Pat. No. 6,719,652, U.S. Pat. No. 6,238,310, U.S. Pat. No. 4,277,069, U.S. Pat. No. 4,252,325, U.S. Pat. No. 4,212,463, U.S. Pat. No. 4,166,619, U.S. Pat. No. 3,617,060, U.S. Pat. No. 3,393,912, U.S. Pat. No. 2,554,012, U.S. Pat. No. 2,467,838, U.S. Publication No. 2007/0225093, U.S. Publication No. 2003/0166425. However, many of the prior devices have employed conduits or other structures that impede blood flow are otherwise less than satisfactory. Moreover, such previous efforts have not adequately addressed the other problems discussed above.

Accordingly, there exists a need for a hunting arrow assembly that will produce a substantial external discharge of blood from a wounded game animal to aid the hunter in tracking and recovering the animal. Furthermore, there exists a need for such an arrow having a reduced effective cross-section as compared with conventionally fletched arrows to aid in passing through brush and branches and similar obstacles, and that enjoys reduced air resistance and improved aerodynamic performance relative to conventionally fletched arrows. Still further, there exists a need for such an arrow having a reduced visibility to a game animal, particularly as the arrow is moved in the course of being positioned on the bow and aimed.

SUMMARY OF THE INVENTION

The present invention addresses the problems cited above, and provides a hunting arrow having an interior passage through which both air and blood flow substantially unobstructed, so as to employ the flow of air to stabilize the arrow during flight without use of fletching and to release blood following penetration to enhance tracking of the game animal.

Broadly, the hunting arrow comprises: (a) a tubular shaft, the tubular shaft comprising an interior passage that permits both the flow of air and the flow blood to pass from a forward end of the shaft to a rearward end of the shaft; (b) a broadhead mounted to the forward end of the tubular shaft, the broadhead comprising an intake opening that permits both the flow of air and the flow of blood to enter the forward end of the tubular shaft in a generally axial direction therethrough; and (c) a nock mounted on the rearward end of the tubular shaft, the nock comprising a discharge opening that permits both the flow of air and the flow of blood to exit the rearward end of the tubular shaft in a generally axial direction therethrough.

The broadhead may comprise a plurality of blades extending forward of the intake opening, the blades being spaced apart radially to permit the flow of air and the flow of blood to pass by the blades so as to enter the intake opening. The broad head may further comprise an axial peg having inner edges of the plurality of blades mounted thereto forward of the intake opening.

The nock that is mounted at the rearward end of the tubular shaft may further comprise at least one vane structure protruding into the discharge opening of the nock that reacts with the flow of air exiting the discharge opening to impart axial rotation to the arrow. The at least one vane structure may comprise first and second vane structures that protrude into the flow of air, each of the vane structures comprising at least one angled surface that is impinged by the flow of air to impart the axial rotation to the arrow. The first and second vane structure may comprise first and second vane structures formed on opposite sides of the discharge opening.

Each of the vane structures may comprise a raised rib structure that protrudes into the discharge opening of the nock. The first and second vane structures on opposite sides of the discharge opening may further comprise first and second rearwardly extending leg portions each having a bow string notch formed in an end thereof.

The nock may further comprise a plurality of radially spaced outwardly facing channels that react with air passing over and exterior of the nock to stabilize the arrow during flight. The nock may further comprise a plurality of vent portions that permit a portion of the flow of air to escape from the interior passage of the tubular shaft so as to flow over the outwardly facing channels of the nock. The vent portions of nock may comprise forward portions of the outwardly facing channels that are depressed within the rearward end of the tubular shaft so as to form gaps with the wall of the shaft that permit the portion of the flow of air to escape therethrough. The outwardly facing channels of the nock may each comprise a concavely dished channel that reacts the flow of air passing over the exterior of the nock in a radially outward and rearward direction to generate a radially force that stabilizes the arrow during flight.

These and other features and advantages of the present invention will be more fully appreciated from a reading of the following detailed description with reference to the accompanying drawings.

DETAILED DESCRIPTION

Figure 1:
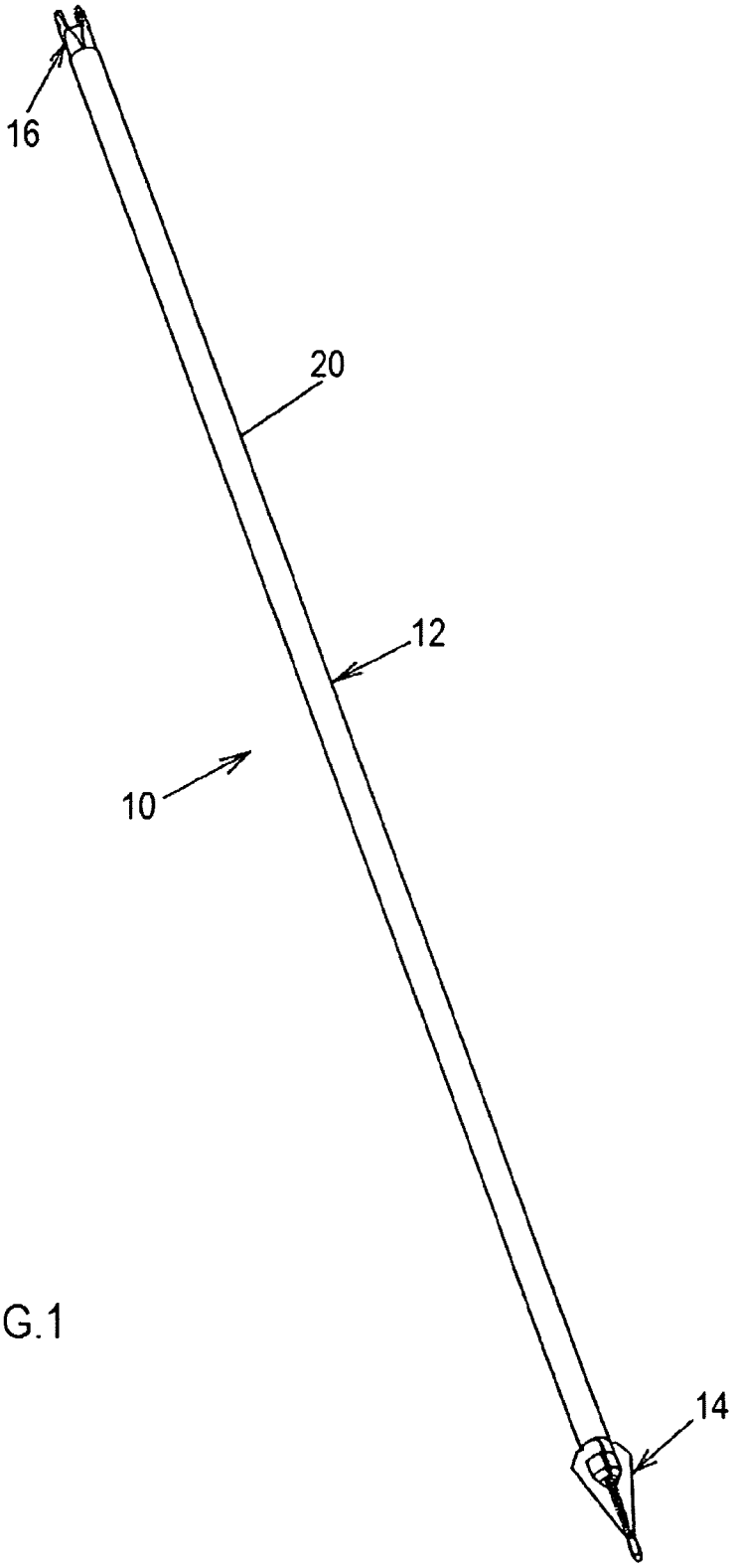
FIG. 1 is a perspective view of an arrow assembly in accordance with the present invention, having a tubular shaft with a broadhead having an intake opening mounted at the forward end and a fletchless nock having a discharge opening mounted at the rearward end.

FIG. 1 shows an arrow assembly 10 in accordance with the present invention. As can be seen, the arrow assembly includes a shaft 12 having a broadhead 14 mounted at the forward end in a nock 16 mounted at the rearward end.

The shaft 12 is formed of a tubular member 20 having a hollow interior that forms a substantially straight through, unobstructed flow path between the forward and rearward end of the shaft. The passage 22 (see FIGS. 17-18) accommodates both flow of air therethrough during flight of the arrow, and then blood released from a game animal following penetration by the arrow. The tubular shaft may be formed, for example, of aluminum alloy or other metal, graphite fiber composite or other composite materials, or extruded or molded plastic material.

Figure 2:
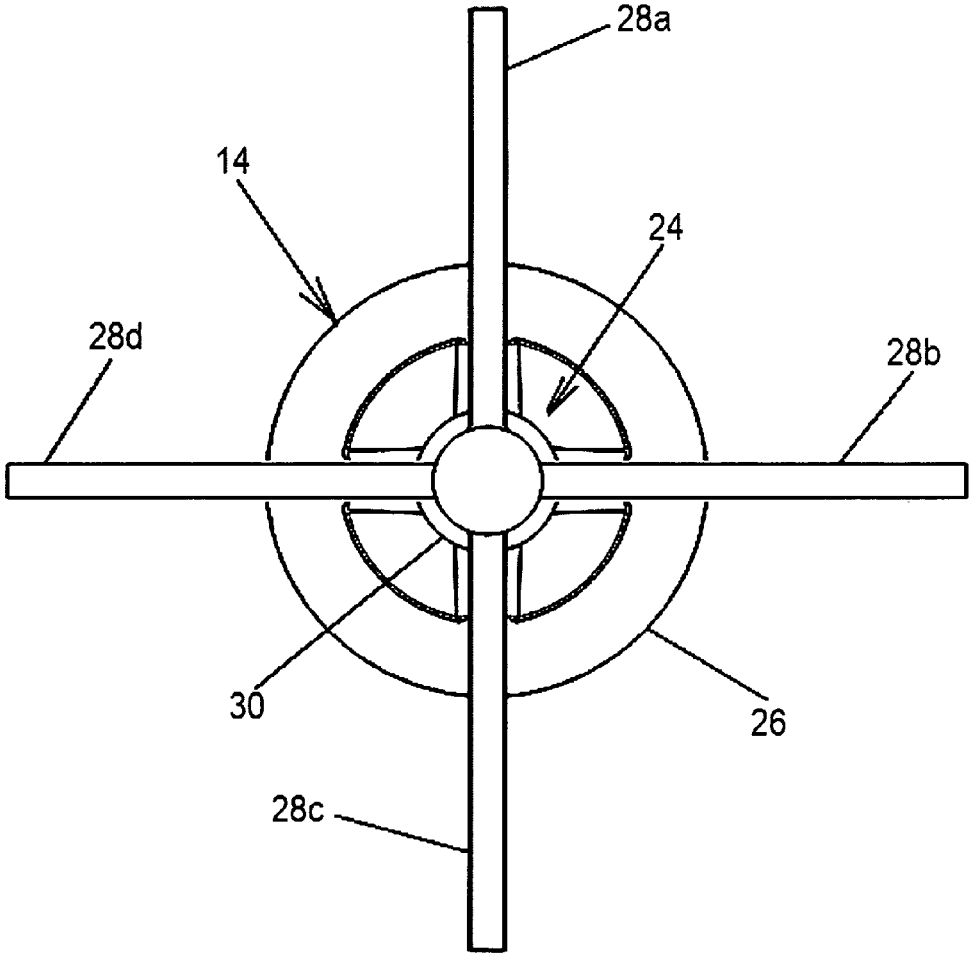
FIG. 2 is a front elevational view of the broadhead of the arrow assembly of FIG. 1, showing the intake opening by which flows of air and blood enter the forward end of the assembly.
Figure 3:
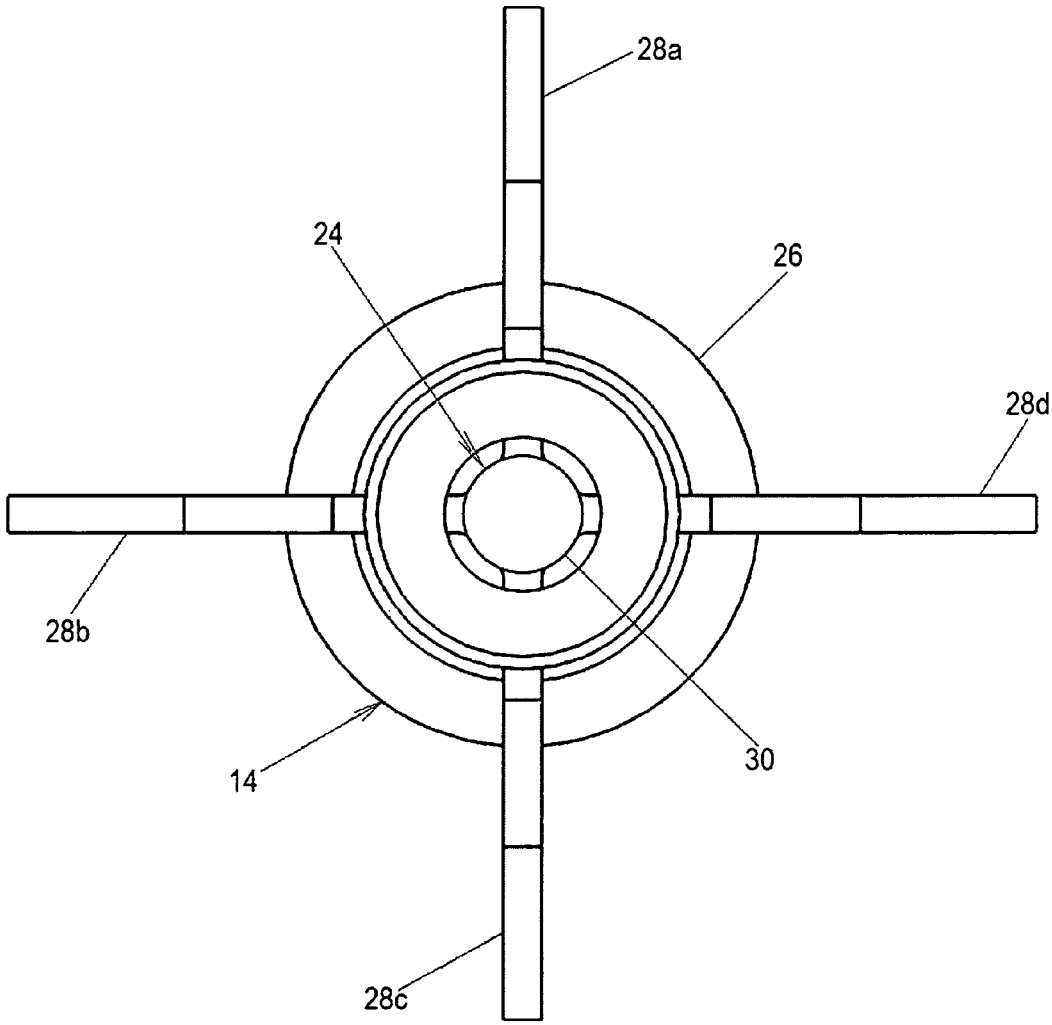
FIG. 3 is a rear elevational view of the broadhead of FIG. 2, showing the rearward end of the intake opening that leads into the tubular shaft of the arrow assembly.

As can be seen in FIGS. 2-3, broadhead 14 in turn includes a forward facing intake opening 24 formed centrally in the body 26 of the broadhead, the intake opening being aligned generally axially with the tubular shaft 20. Blades 28*a*-28*d* are mounted to a smaller diameter post 30 that is set within and extends forwardly from intake opening 24, the blades being comparatively thin and extending radially from the post so as to leave arcuate gaps between the blades through which fluid is able to enter the intake opening in a substantially unobstructed manner. During flight, a flow of air enters the intake opening 24 at high speed and is directed axially into the tubular shaft of the arrow assembly; then, following penetration of a game animal a flow of blood similarly enters the intake opening under pressure and flows from there to the passage through the elongate shaft.

Figure 4:
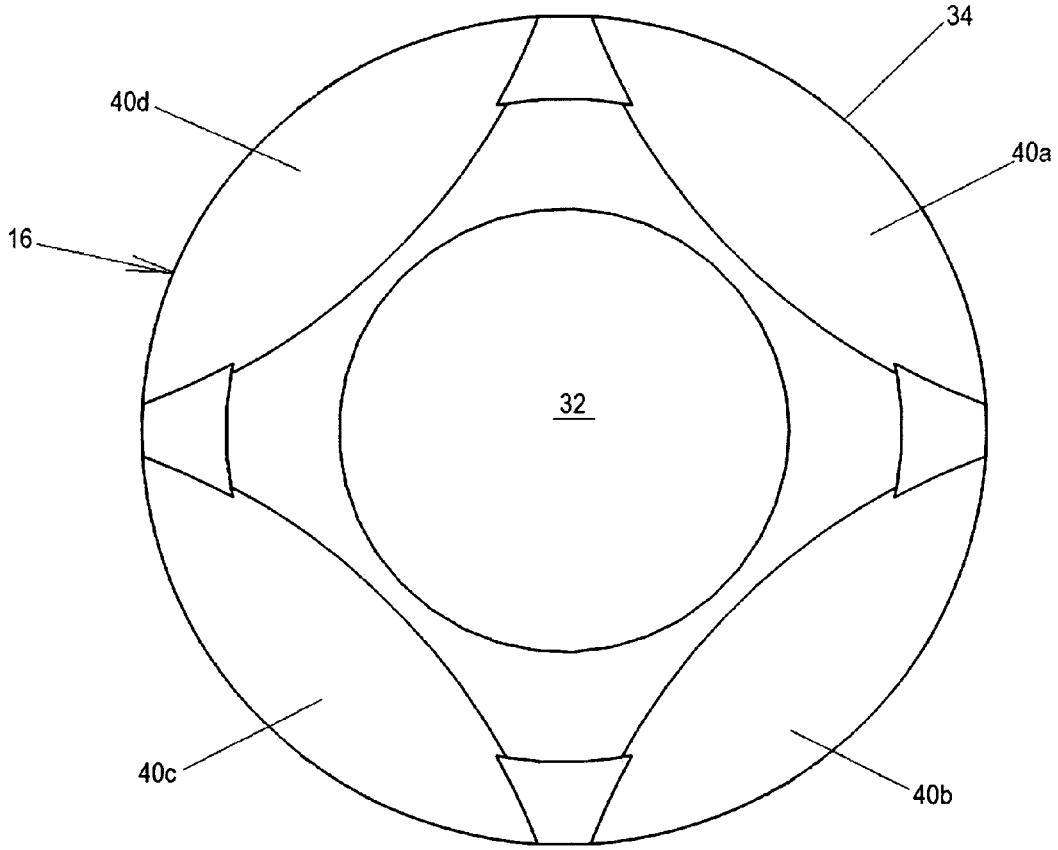
FIG. 4 is a front elevational view of the fletchless nock of the arrow assembly of FIG. 1, showing the forward end of the discharged opening through which air or blood passing through the tubular shaft is released at the rearward end of the assembly.
Figure 5:
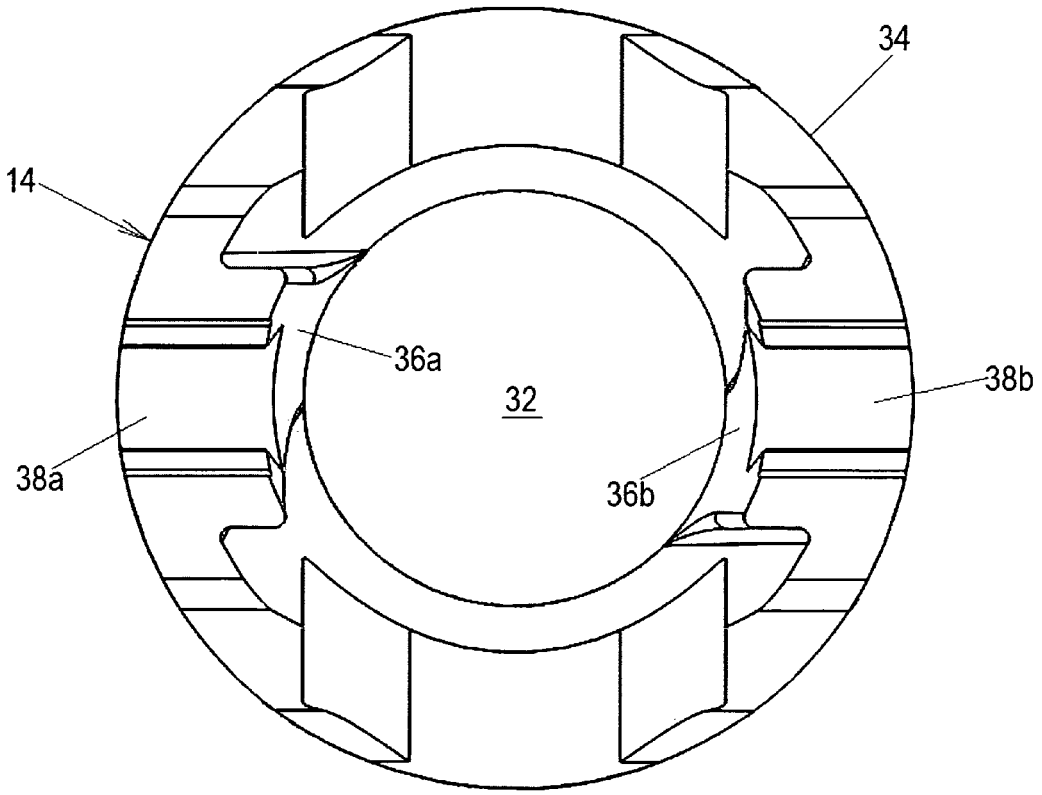
FIG. 5 is a rear elevational view of the fletchless nock of FIG. 4, showing the rearward end of the discharge port and also the vane structures on the inside of the nock that cooperate with the flow of air exiting the opening to impart rotation to the arrow assembly during flight.

Having entered the forward end of the tubular arrow shaft 20 under pressure, the flow of air on the one hand and blood on the other travels through the open, unobstructed internal passage of the shaft to reach the nock 16 that is mounted at the rearward end of the shaft. As can be seen in FIG. 4, the flow enters the forward end of a discharge opening 32 formed in the body 34 of the nock, the discharge opening being aligned with the bore of the tubular shaft so that the fluid passes into and through the opening in a substantially unobstructed manner. Lengthwise extending vane structures 36*a*, 36*b* are formed on the inside of the nock around opening 32 that react the flow of air through the opening to impart axial rotation to the arrow assembly, as will be described in greater detail below, thus obviating, the need for external fletching. The vane structures 36*a*-*b* also form rearwardly extending leg portions of the nock having string notches that engage the cooperating string of a bow. As will be described in greater detail below, a portion of the airflow through gaps between the inside surface of the tubular shaft and leading edges of channels 40*a*-40*d* formed around the perimeter of body 34 so as to react against external features of the nock to impart additional stability to the assembly.

Thus, when launched from a bow the flow of air passes through the interior of the assembly at a rate corresponding generally to the speed of the arrow, the openings 24 and 32 and the bore 22 of the shaft, with the flow being reacted by the nock to import rotation and stabilize the assembly during flight. Then, following penetration of the target animal blood flow freely from deep within the wound to the nock at the rearward end of the arrow assembly, from which it is discharged to form a prominent trail to facilitate tracking and recovery of the animal.

Figure 6:
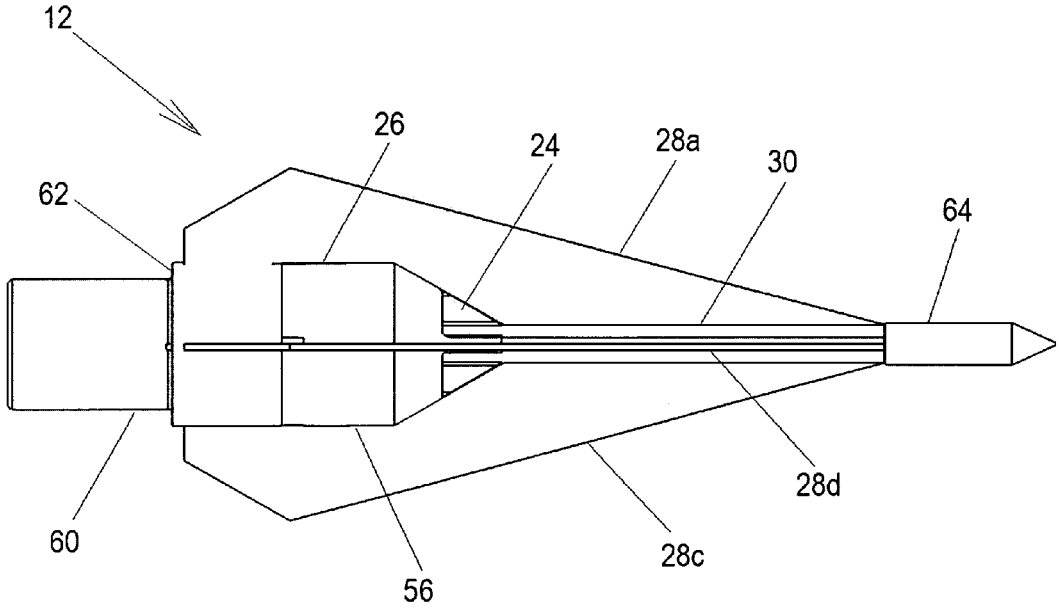
FIG. 6 is a partially ghosted side elevational view of the broadhead of the arrow assembly of FIG. 1.
Figure 7:
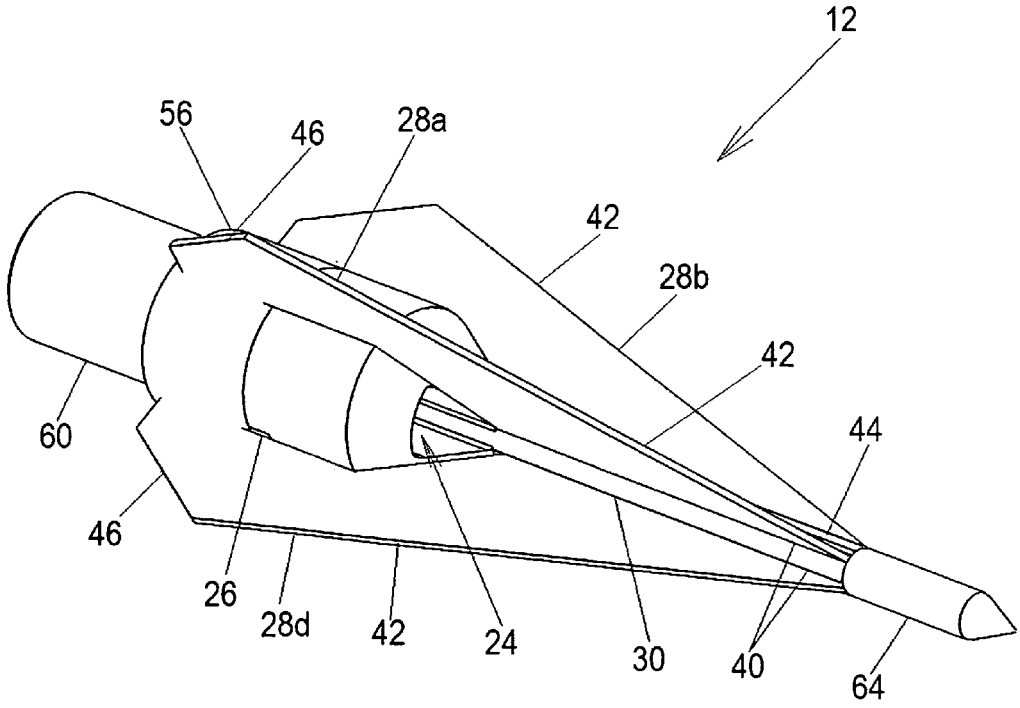
FIG. 7 is a front perspective view of the broadhead of FIG. 6, showing in greater detail the forward end of the intake opening formed between the blades of the broadhead.
Figure 8:
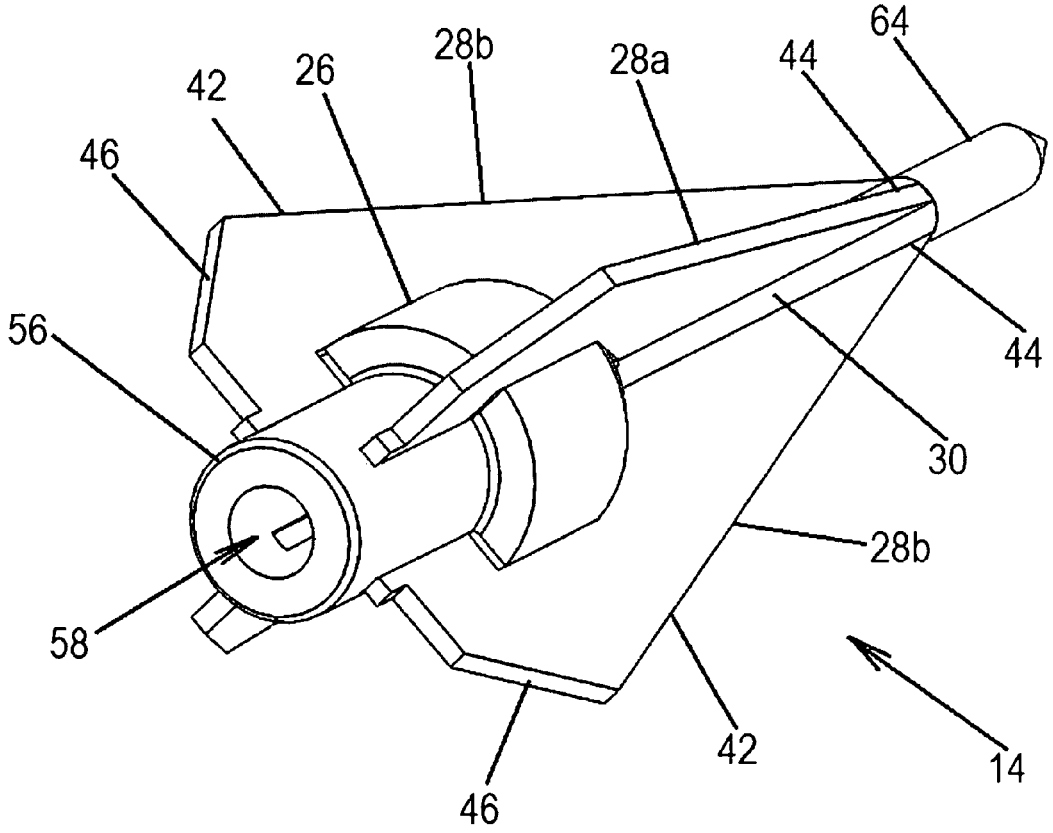
FIG. 8 is a rear perspective view of the broadhead of FIGS. 6-7, showing the rearward end of the intake opening that communicates with the tubular passage of the arrow shaft and also showing the structure of the broadhead in greater detail.
Figure 9:
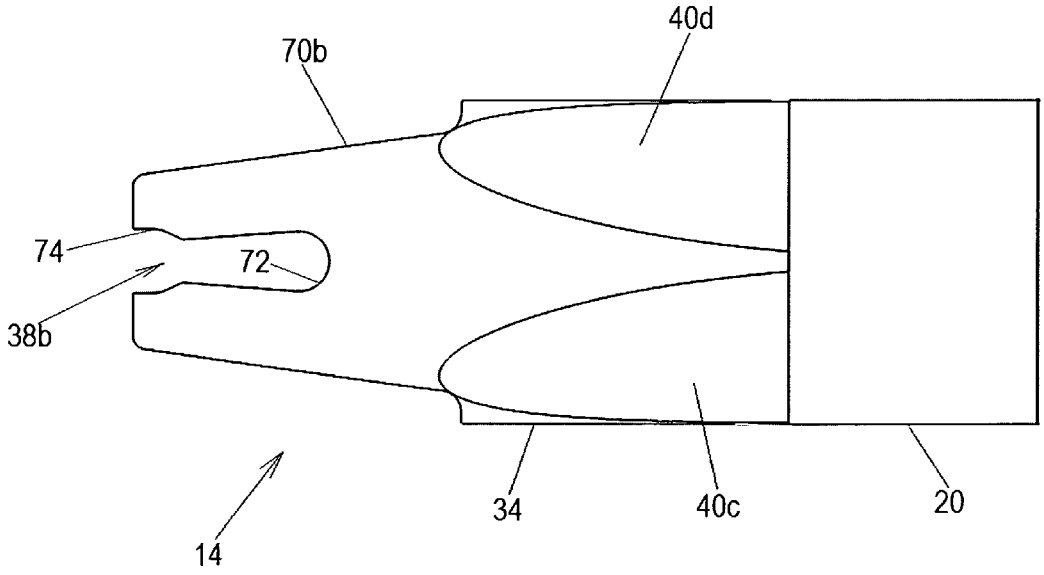
FIG. 9 is an elevational view of the fletchless nock and the rearward end of the tubular shaft of the arrow assembly of FIG. 1.
Figure 10:
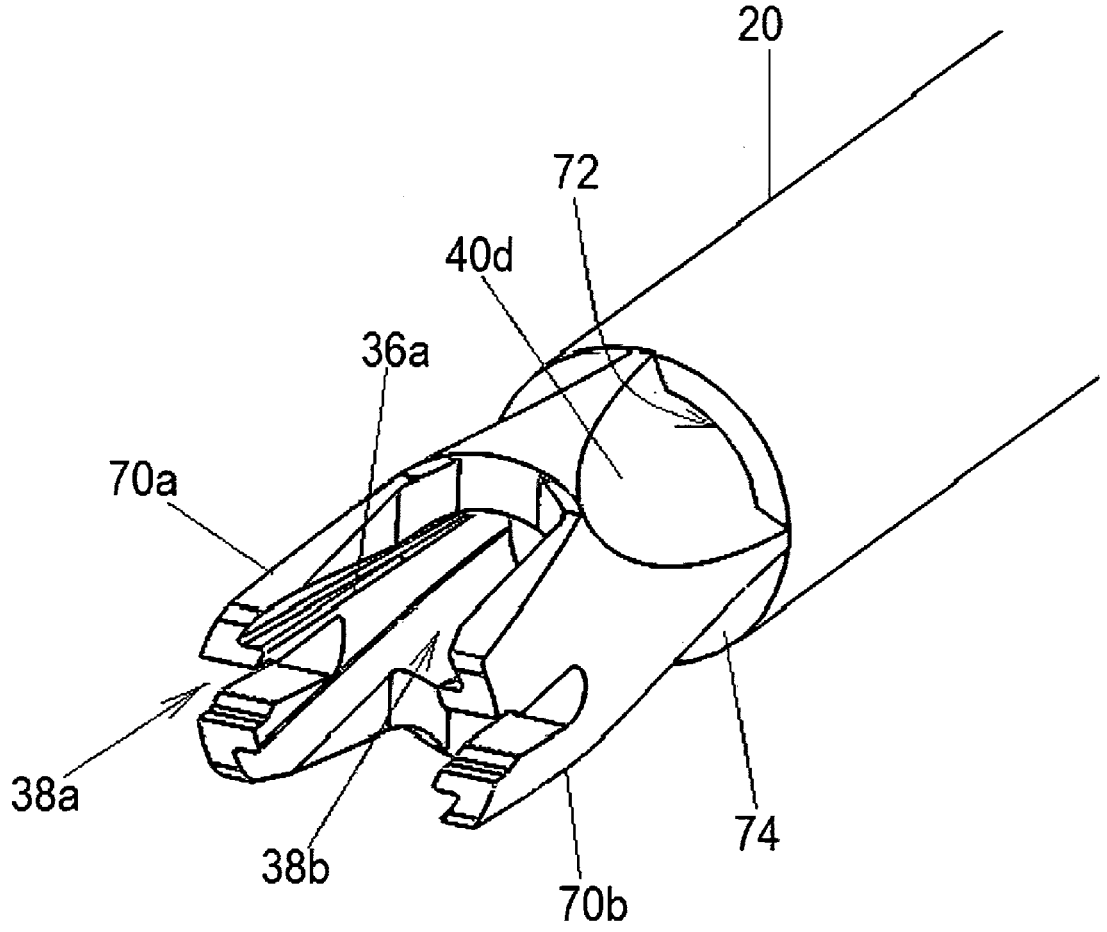
FIG. 10 is a perspective view of the nock and shaft end of FIG. 9, showing in greater detail the string notches formed in first and second rearwardly extending leg portions of the nock.
Figure 11:
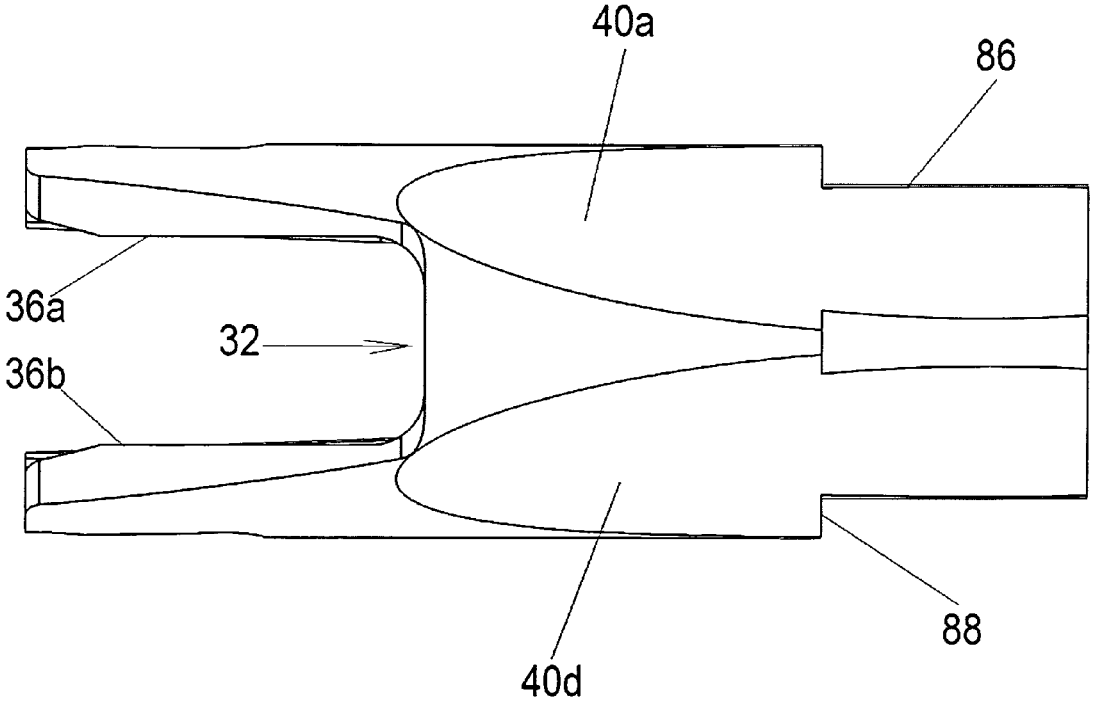
FIG. 11 is a top plan view of the fletchless nock of the arrow assembly of FIG. 1.
Figure 12:
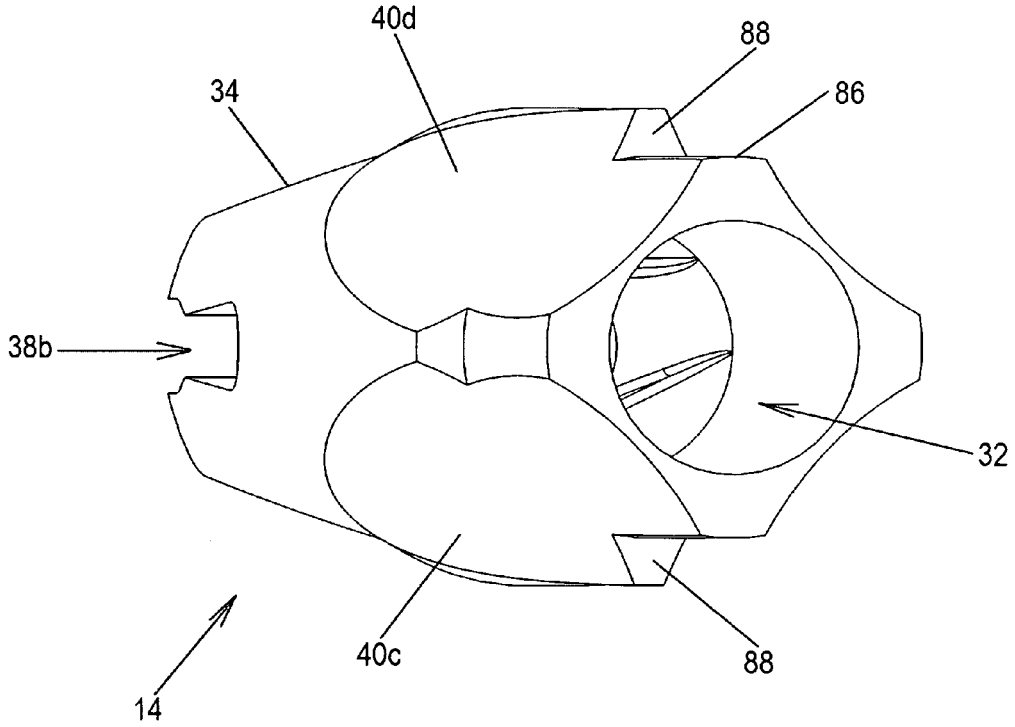
FIG. 12 is a front perspective view of the fletchless nock of FIG. 11, showing the forward end of the discharge opening and also the mounting structure that attaches to the rearward end of the tubular shaft of the arrow.
Figure 13:
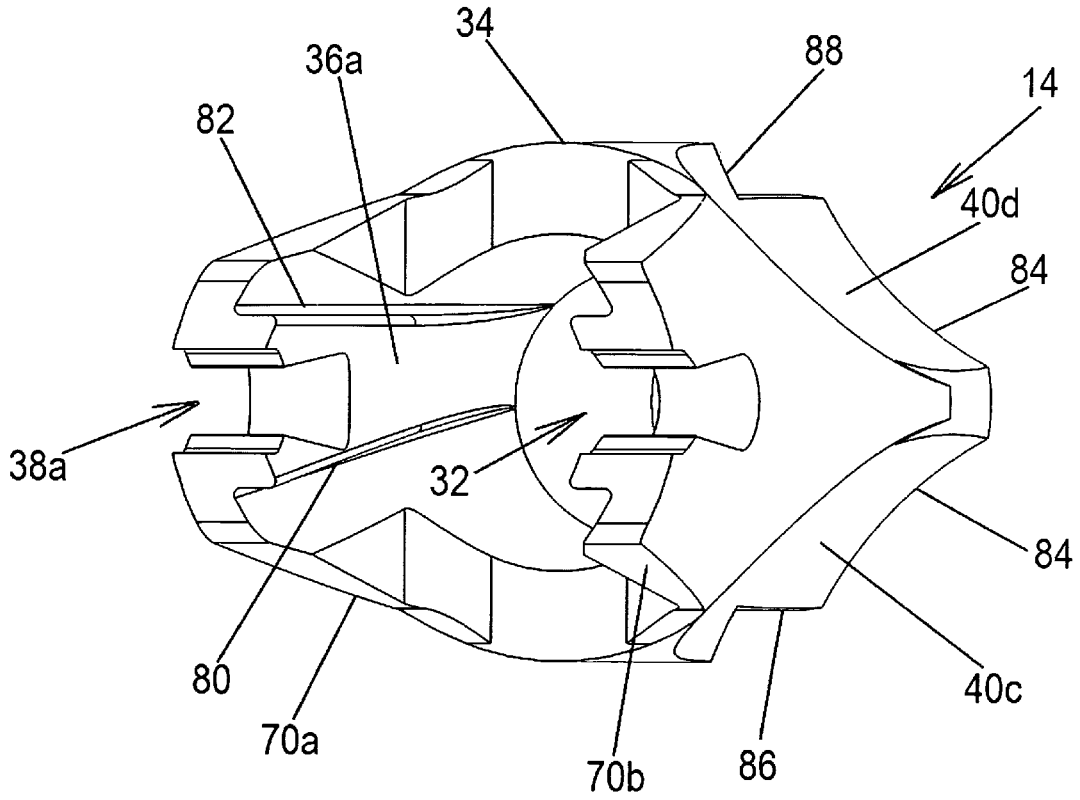
FIG. 13 is a first rearward perspective view of the fletchless nock of FIGS. 11-12, showing the rearward end of the discharge opening and also a first one of the vane structures inside the nock that cooperate with the flow of air exiting the opening to impart rotation to the arrow assembly.
Figure 14:
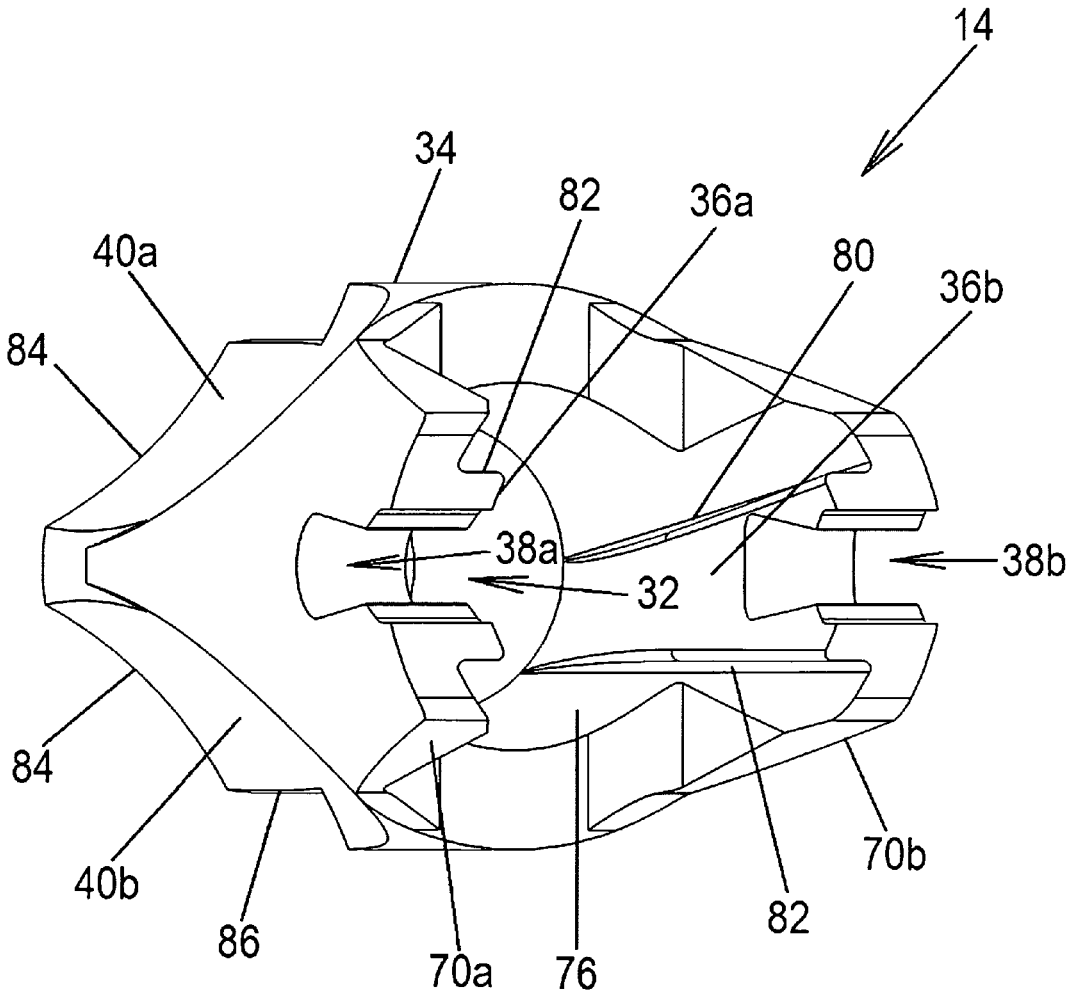
FIG. 14 is a second perspective view of the fletchless nock of FIGS. 11-13, looking from the opposite side from FIG. 13, showing the second internal vane structure that cooperates with the flow of air to impart rotation to the arrow assembly.

The structure of the broadhead assembly 12 is shown in greater detail in FIGS. 6-8. As can be seen, the body 26 of the assembly is broadly cylindrical at its base, with the center post 30 extending forwardly and being provided with grooves 40 into which the base edges of the blades 28*a*-*c* are set. The blades are somewhat triangular in overall form, with sharpened outer edges 42 that taper towards pointed forward ends 44, and trailing edges 46 that taper back inwardly towards the rearward end of the assembly, with inner edges 48 of the blades in this area being received in cooperating radially extending slots 50 formed in the body 26 of the broadhead. The base ends of the blades are notched, forming longitudinally extending tang portions 52 that are set within portions of the slots 50 that extend into a reduced diameter threaded base 54 extending rearwardly from body 26. When the blades are installed in body 26 an elastomeric O-ring (not shown) may be placed over the tangs to hold the blades in position, an internally threaded collar 56 then being threaded onto the base extension of the body and tightened to secure the blades in the assembly. As can be seen in FIG. 8, the collar 56 includes a bore 58 that forms an axial extension of intake opening 24, with the rearward end of the collar being necked down to form a stub portion 60 that fits within the bore 22 (when installed) of the arrow shaft and an annular shoulder 62 that buts against the forward end of the shaft.

At the forward end of the broadhead assembly, the tip portions 44 of the blades fit under and are secured to the center post by the rearward end of a pointed tip piece 64 that is installed on a threaded extension 66 of the post. The tip piece may be provided in different weights to aid in balancing the overall assembly and to suit varying conditions and game animals and individual hunter preferences.

In the illustrated embodiment, the body and collar members may suitably be formed of tough molded plastic while the blades and tip may suitably be formed of metal, however it will be understood that metals, plastics and/or composite materials may be employed for any or all of these pieces in some embodiments. Moreover, it will be understood that the numbers, shapes and mounting features of the blades and other components may vary depending on design factors, provided that the intake opening communicating generally axially with the interior of the tubular shaft is included.

FIGS. 9-18 in turn illustrate the fletchless nock that is mounted at the rearward end of the tubular shaft, from which air/blood exists rearwardly from the assembly. As noted above, the nock includes a body 34, suitably formed of injection molded plastic, for example. The nock mounts at the rearward end of the tubular shaft 20 of the arrow assembly, and includes first and second rearwardly extending leg portions 70*a*, 70*b* having string notches 38*a*, 38*b* formed at their trailing ends, the notches each including a main slot 72 contoured to hold the string and a somewhat tapered throat 74 by which the string enters and exits the main slot. As was described above and as can be seen in FIGS. 10-11, the air vanes 36*a*, 36*b* of the nock are formed on the inside surfaces of the legs 70*a*, 70*b*, which flank the axial discharge opening 32 of the nock. External scoop-shaped channels 40*a*, 40*d* formed about the outside perimeter of the nock in turn cooperate with air escaping through notches 72 between the necked down forward end of the nock and the butt end 74 of the tubular shaft, as also noted above.

As can be seen in greater detail in FIGS. 13-16, vanes 36*a*-36*b* in the illustrated embodiment are formed as somewhat rib-shaped structures that are raised relative to the generally circular cross-section of the inside wall 76 of the nock so as to protrude into the flow of air passing through and exiting opening 32, the trailing edges of the vane ribs being generally bifurcated by the string notches 38*a*, 38*b*. Each of the vanes includes at least one angled face 80 extending generally lengthwise, that is angled relative to the axis of the assembly so that the flow of air reacts against the angled face to impart a rotational force to the nock. In the illustrated embodiment, the angled face 80 on the first (left, looking forward) vane 36*a* is angled upwardly while the corresponding face 80 on the second (right) vane 36*b* is angled downwardly, so as to impart a rotational force in a clockwise direction. It will be understood that in some embodiments the faces of the vanes may be angled in the opposite direction so as to impart rotation in the opposite, counterclockwise direction. Due to their relatively greater off-axis angle, air flowing through the discharge opening 32 will impinge primarily on the angled surfaces 80 of the vanes. As can also be seen in FIGS. 15-16, the secondary faces 82 of the vane structures 36*a*, 36*b* may be angled generally in the same direction as the main angled faces 80 to cooperate in generating the rotational motion, although it will be understood that in some instances the secondary faces may be more-or-less straight, or may be absent with the edges faired into the surface. It will also be understood that in some embodiments the vanes may be greater or fewer in number, or may be more blade-like or fin-like in form; furthermore, while the nock of the present invention dispenses with the need for external fletching, it is envisioned that a certain amount of fletching may be included in some instances.

Figure 17:
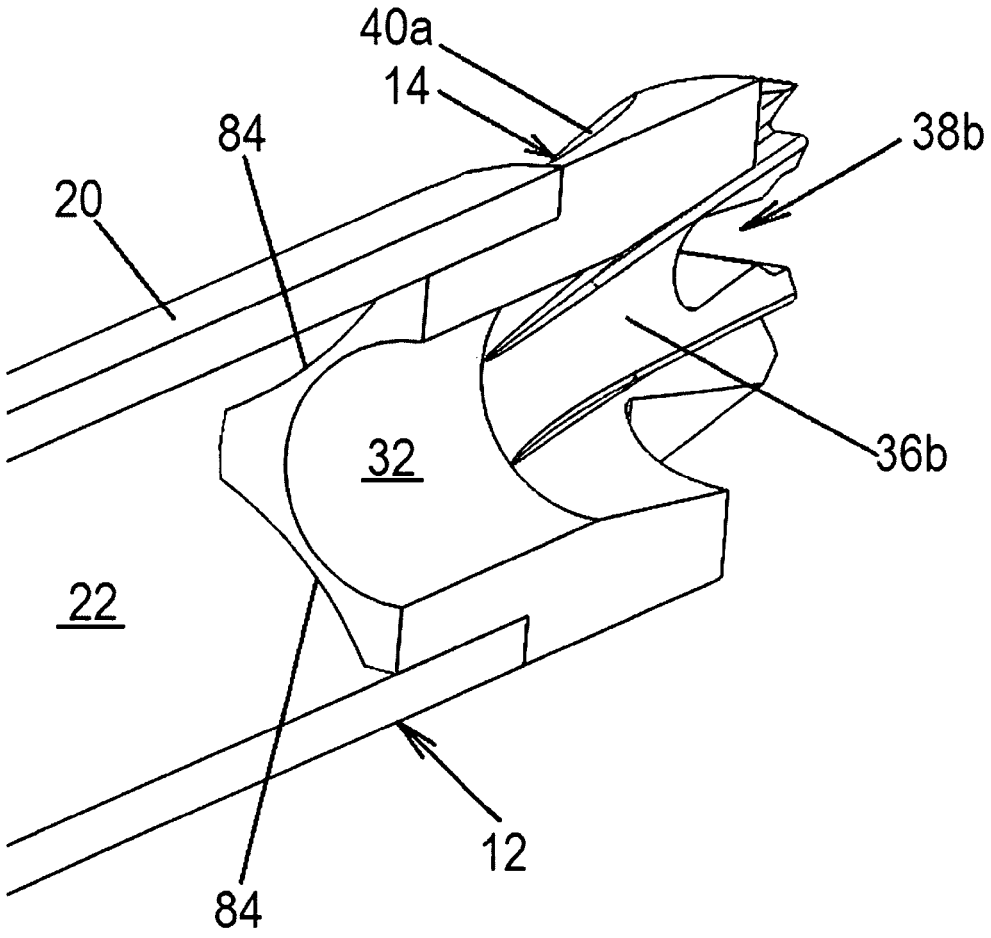
FIG. 17 is a cross-sectional view of the fletchless nock and the end of the tubular shaft of FIGS. 9-10, showing the manner in which channels formed on the outside of the nock permit a portion of the air passing through the tubular shaft to exit externally through gaps at the end of the shaft so as to cooperate with exterior surfaces of the nock to impart stability to the arrow assembly.
Figure 18:
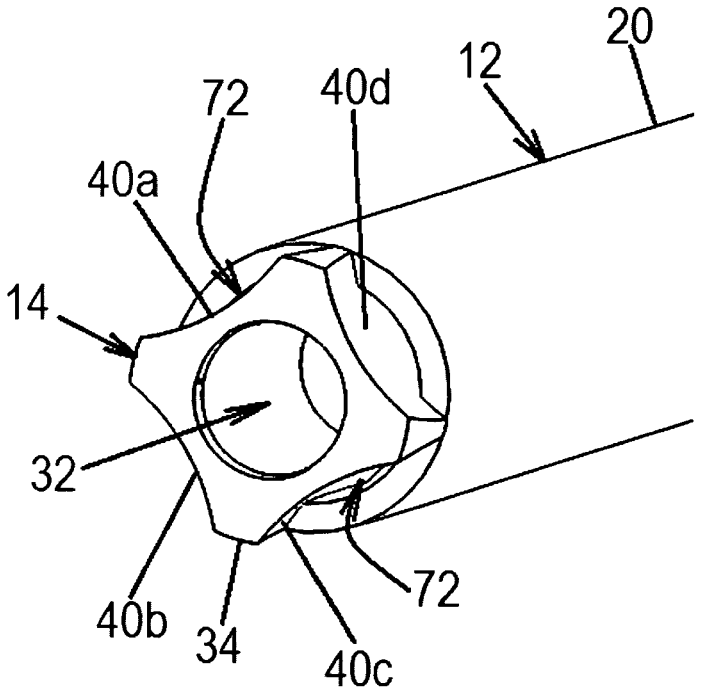
FIG. 18 is a transverse cross-sectional view of the nock and shaft end of FIGS. 9-10, showing in greater detail the vent gaps that permit a portion of the airflow to escape over the outside and cooperate with external features of the nock.

As noted above, a portion of the airflow also exits through the gaps 72 between the wall of the tubular shaft 20 and the scoop-shaped external channels 40*a*-40*d* of the nock. As can be seen in FIGS. 17-18, the leading edges 84 and forward portions of channels 40*a*-40*d* are depressed relative to the main diameter of the body of the nock so that the forward ends of the channels are depressed within the interior of the tubular shaft to form the discharge gaps 72. The air escaping through the gaps is therefore divided between the forward channels and is deflected radially by the concaving dished surfaces thereof in a rearward and outward pattern. The ballasted inward force, directed radially inwardly towards the axis of the arrow assembly, contributes to stability of the arrow during flight and helps obviate the need for external fletching.

Figure 15:
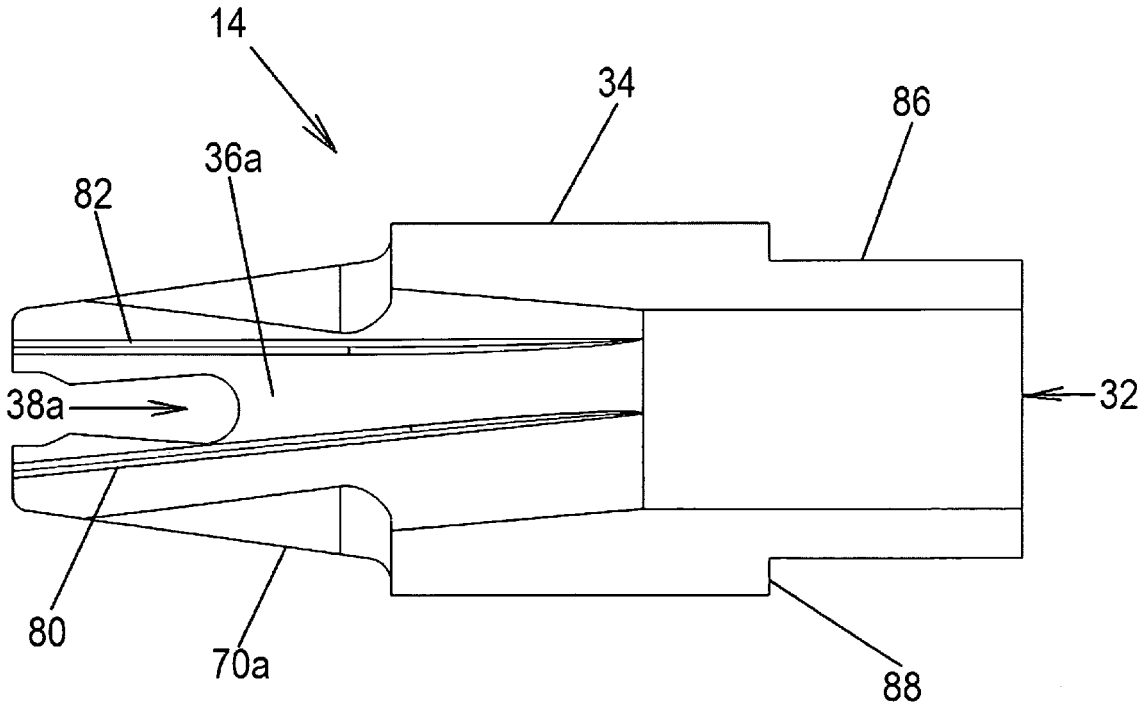
FIG. 15 is a first longitudinal cross-sectional view of the fletchless nock of FIGS. 11-14, showing in greater detail the manner in which the first vane structures extends at an angle to the longitudinal axis of the air passage of the nock so as to react with the flow of air exiting the discharge opening.
Figure 16:
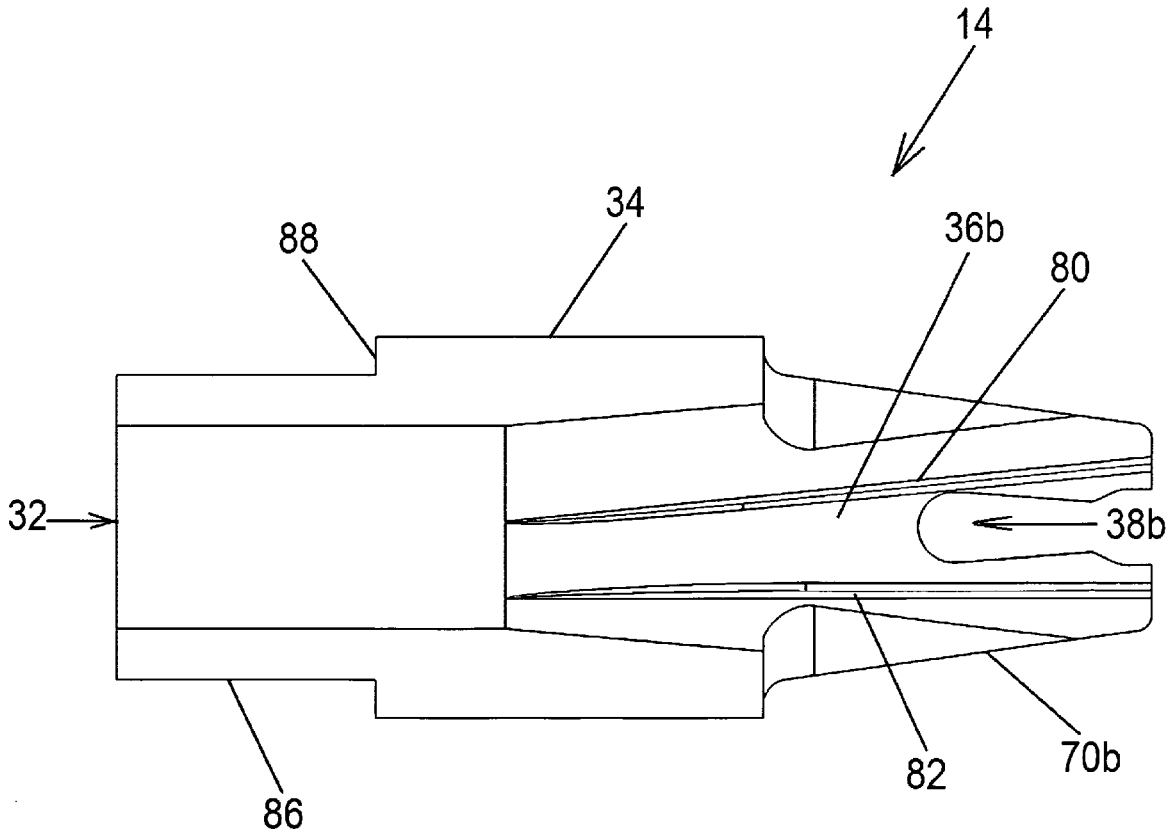
FIG. 16 is a second longitudinal cross-sectional view of the fletchless nock of FIGS. 11-14, looking from the opposite side from the view of FIG. 15, showing the manner in which the second internal vane structure is angled relative to the longitudinal axis of the flow passage so as to cooperate with the first vane structure to impart rotation to the arrow assembly.

As can best be seen with further reference to FIG. 15, the forward end of the body of the nock intermediate the scoop-shaped channels has a reduced diameter, so as to form a forwardly extending stud portion 86 that fits within and engages the rearward end of the tubular shaft 22 of the arrow. An outward shoulder 88 at the rearward end of the stud portion in turn buts against the end of the tubular shaft to arrest insertion of the nock and to transfer loads from the bow string to the shaft in conjunction with the stud portion 86 of the nock.

It will be understood that the scope of the appended claims should not be limited by particular embodiments set forth herein, but should be construed in a manner consistent with the specification as a whole.

What is claimed is:

1. A hunting arrow, comprising:
- a tubular shaft, said tubular shaft comprising:
  - an interior passage that permits both a flow of air and a flow of blood to pass from a forward end of said shaft to a rearward end of said shaft;
  - a broadhead mounted to said forward end of said tubular shaft, said broadhead comprising:
    - an intake opening that permits both said flow of air and said flow of blood to enter said forward end of said tubular shaft in a generally axial direction therethrough; and
    - a nock mounted on said rearward end of said tubular shaft, said nock comprising:
      - a discharge opening that permits both said flow of air and said flow of blood to exit said rearward end of said tubular shaft in a generally axial direction therethrough; and
      - at least one vane structure protruding into said discharge opening of said nock so as to react said flow of air exiting said discharge opening to impart axial rotation to said arrow.

2. The hunting arrow of claim 1, wherein said broadhead further comprises:
- a plurality of blades extending forward of said intake opening, said blades being spaced apart radially to permit said flow of air and said flow of blood to pass by said blades so as to enter said intake opening.

3. The hunting arrow of claim 2, wherein said broadhead further comprises:
- an axial peg having inner edges of said plurality of blades mounted thereto forward of said intake opening.

4. The hunting arrow of claim 1, wherein said at least one vane structure of said nock comprises:
- first and second vane structures that protrude into said flow of air, each of said vane structures comprising:
  - at least one angled surface that is impinged by said flow of air to impart said axial rotation to said arrow.

5. The hunting arrow of claim 4, wherein said first and second vane structures comprise:
- first and second vane structures formed on opposite sides of said discharge opening.

6. The hunting arrow of claim 5, wherein each of said vane structures comprises:
- a raised rib structure that protrudes into said discharge opening of said nock.

7. The hunting arrow of claim 6, wherein said first and second vane structures on opposite sides of said discharge opening further comprise:
- first and second rearwardly extending leg portions each having a bow string notch formed in an end thereof.

8. The hunting arrow of claim 1, wherein said nock further comprises:
- a plurality of radially spaced outwardly facing channels that react with air passing over an exterior of said nock to stabilize said arrow during flight.

9. The hunting arrow of claim 8, wherein said nock further comprises:
- a plurality of vent portions that permit a portion of said flow of air to escape from said interior passage of said tubular shaft so as to flow over said outwardly facing channels of said nock.

10. The hunting arrow of claim 9, wherein said vent portions of said nock comprise:
- forward portions of said outwardly facing channels that are depressed within said rearward end of said tubular shaft so as to form gaps with a wall of said shaft that permit said portion of said flow of air to escape therethrough.

11. The hunting arrow of claim 10, wherein said outwardly facing channels of said nock each comprise:
- a concavely dished channel that reacts said flow of air passing over said exterior of said nock in a radially outward and rearward direction to generate a radially inward force that stabilizes said arrow during flight.

12. A hunting arrow, comprising:
- a tubular shaft, said tubular shaft comprising:
  - an interior passage that permits both a flow of air and a flow of blood to pass from a forward end of said shaft to a rearward end of said shaft;
  - a broadhead mounted to said forward end of said tubular shaft, said broadhead comprising:
    - an intake opening that permits both said flow of air and said flow of blood to enter said forward end of said tubular shaft in a generally axial direction therethrough;
    - a plurality of blades extending forward of said intake opening, said blades being spaced apart radially to permit said flow of air and said flow of blood to pass by said blades so as to enter said intake opening;
    - an axial peg having inner edges of said plurality of blades mounted thereto forward of said intake opening; and
    - a nock mounted on said rearward end of said tubular shaft, said nock comprising:

a discharge opening that permits both said flow of air and said flow of blood to exit said rearward end of said tubular shaft in a generally axial direction therethrough.

* * * * *